US011773770B2

(12) United States Patent
Chaubey et al.

(10) Patent No.: US 11,773,770 B2
(45) Date of Patent: Oct. 3, 2023

(54) INTAKE CLEANER AND DISPENSE MECHANISM

(71) Applicant: Energizer Auto, Inc., St. Louis, MO (US)

(72) Inventors: Girija S. Chaubey, Beavercreek, OH (US); Tushar Kulkarni, Englewood, OH (US); Nathan Myers, Dayton, OH (US); Rajeev Menon, Dayton, OH (US)

(73) Assignee: Energizer Auto, Inc., St. Louis, MO (US)

( * ) Notice: Subject to any disclaimer, the term of this patent is extended or adjusted under 35 U.S.C. 154(b) by 234 days.

(21) Appl. No.: 16/866,882

(22) Filed: May 5, 2020

(65) Prior Publication Data

US 2020/0355116 A1 Nov. 12, 2020

Related U.S. Application Data

(60) Provisional application No. 62/845,522, filed on May 9, 2019.

(51) Int. Cl.
*F02B 77/04* (2006.01)

(52) U.S. Cl.
CPC ..... *F02B 77/04* (2013.01); *F02B 2077/045* (2013.01)

(58) Field of Classification Search
CPC ..... F02B 77/04
See application file for complete search history.

(56) References Cited

U.S. PATENT DOCUMENTS 3,232,487 A 2/1966 Edson
3,329,314 A * 7/1967 Kolodziej ..... B65D 83/262 239/70

(Continued)

FOREIGN PATENT DOCUMENTS

CN 110284969 A * 9/2019
DE 102015110970 1/2016

(Continued)

OTHER PUBLICATIONS

International Search Report/Written Opinion for Corresponding PCT/US 20/31446 dated Aug. 4, 2020, 14 pages.

(Continued)

*Primary Examiner* — Spencer E. Bell
*Assistant Examiner* — Omair Chaudhri
(74) *Attorney, Agent, or Firm* — Lee & Hayes, P.C.

(57) ABSTRACT

An apparatus for cleaning an intake system of an engine includes a pressure-resistant container having a reservoir chargeable with an engine cleaner composition and a discharge orifice for discharging the engine cleaner composition from the reservoir. The apparatus also includes a dispensing assembly including an assembly inlet connectable to the discharge orifice of the pressure-resistant container for receiving the engine cleaner composition discharged from the pressure-resistant container. The dispensing assembly further includes an assembly outlet, and a length of tubing for receiving the engine cleaner composition from the dispensing assembly. The apparatus further includes a timer configured to control a timed valve that, when opened, allows the engine cleaner composition to discharge from the pressure-resistant container. The timer is configured to delay opening of the timed valve for a predetermined period of time after actuation of the timer.

20 Claims, 5 Drawing Sheets

(56) References Cited

U.S. PATENT DOCUMENTS

| | | | | | |
|---|---|---|---|---|---|
| 3,448,743 | A * | 6/1969 | Berry | B08B 9/28 | 134/152 |
| 4,006,844 | A * | 2/1977 | Corris | B65D 83/262 | 968/815 |
| 4,167,193 | A * | 9/1979 | Magnus | F02B 77/04 | 239/70 |
| 4,989,561 | A * | 2/1991 | Hein | F02B 77/04 | 134/30 |
| 5,161,336 | A * | 11/1992 | Ritt | F02B 77/04 | 451/87 |
| 5,289,837 | A | 3/1994 | Betancourt | | |
| 5,727,514 | A * | 3/1998 | Sunden | F01M 9/02 | 123/198 A |
| 5,826,602 | A | 10/1998 | Chen | | |
| 6,715,502 | B1 | 4/2004 | Rome et al. | | |
| 6,752,159 | B1 | 6/2004 | Kavadeles et al. | | |
| 2005/0167625 | A1* | 8/2005 | Deen | F16K 31/02 | 239/69 |
| 2008/0060680 | A1* | 3/2008 | Esterline | B08B 9/00 | 134/184 |
| 2008/0283098 | A1* | 11/2008 | Ogasawara | F02B 77/04 | 134/22.1 |
| 2016/0102606 | A1* | 4/2016 | Thompson | F02B 77/04 | 134/23 |
| 2017/0159621 | A1* | 6/2017 | Irwin | F02M 35/08 | |
| 2018/0244512 | A1* | 8/2018 | Capra | B01J 4/008 | |
| 2022/0032879 | A1* | 2/2022 | Trebouet | B08B 5/02 | |

FOREIGN PATENT DOCUMENTS

| | | | | |
|---|---|---|---|---|
| EP | 2851535 | B1 * | 2/2018 | B08B 5/00 |
| GB | 2381831 | A * | 5/2003 | F02B 77/04 |
| JP | 3845172 | B2 * | 11/2006 | B65D 83/262 |
| KR | 100649606 | B1 * | 10/2004 | |
| WO | WO-2016204695 | A1 * | 12/2016 | F02B 77/04 |
| WO | WO-2018047005 | A1 * | 3/2018 | B08B 9/027 |
| WO | WO2018047005 | A1 | 3/2018 | |

OTHER PUBLICATIONS

Extended European Search Report dated Dec. 21, 2022 for European Patent Application No. 20802806.8, 9 pages.

* cited by examiner

INTAKE CLEANER AND DISPENSE MECHANISM

CROSS-REFERENCE TO RELATED APPLICATION

This application claims the benefit of priority to U.S. Provisional Patent Application No. 62/845,522 filed on May 9, 2019. The contents of the provisional application are hereby expressly incorporated by reference in their entirety.

FIELD OF THE DISCLOSURE

The present disclosure relates to an apparatus for cleaning the intake system of an automotive internal combustion engine having an air intake manifold.

BACKGROUND OF THE DISCLOSURE

Gas direct injection ("GDI") engines are highly prone to carbon deposits on their intake valves. Large amounts of carbon may get deposited on the intake valves due to the burning of fuel in GDI engines. This causes reduction in performance, horsepower, and gas mileage. Cleaning these deposits is not only time consuming but also complicated and requires more than one person to perform this cleaning process. Furthermore, it is desirable to clean gas direct injection engines frequently, e.g., as often as every 10,000 miles.

Regular cleaning of intake valves is required to maintain engine performance. However, known methods of cleaning intake valves are time consuming, not user-friendly, and require more than one person to perform the cleaning. For example, cleaning intake valves may require one person to remain in a vehicle having the GDI engine and that person must start and rev, or throttle, the GDI engine. A second person may be required to open a hood of the vehicle and manually deliver a cleaning formula to the intake valve, during the time the first person is revving the engine.

SUMMARY OF THE DISCLOSURE

Disclosed is an apparatus for cleaning an intake system of an engine. The apparatus includes a pressure-resistant container having a reservoir chargeable with an engine cleaner composition and a discharge orifice for discharging the engine cleaner composition from the reservoir. The apparatus also includes a dispensing assembly including an assembly inlet connectable to the discharge orifice of the pressure-resistant container for receiving the engine cleaner composition discharged from the pressure-resistant container. The dispensing assembly further includes an assembly outlet, a length of tubing including a tubing inlet, a tubing outlet, and a central bore extending from the tubing inlet to the tubing outlet. The tubing inlet is in fluid communication with the assembly outlet for receiving the engine cleaner composition from the dispensing assembly. The apparatus further includes a timer configured to control a timed valve that, when opened, allows the engine cleaner composition to discharge from the pressure-resistant container. The timer is configured to delay opening of the timed valve for a predetermined period of time after actuation of the timer.

Also disclosed is a method of using an apparatus for cleaning an engine having an air intake manifold. The apparatus includes a fluid-dispensing device having a pressure-resistant container having a reservoir and a discharge orifice. The reservoir is charged with an engine cleaner composition. The apparatus also includes a dispensing assembly having a timer controlling a timed valve, an assembly inlet connected to the discharge orifice, and an assembly outlet. The apparatus further includes a length of tubing having a tubing inlet connected with the assembly outlet, a tubing outlet, and a central bore extending from the tubing inlet to the tubing outlet. The method includes inserting the tubing outlet into the air intake manifold of the engine and actuating the timer to delay an opening of the timed valve for a predetermined period of time after actuation of the timer. The method also includes automatically opening the timed valve after the predetermined period of time after actuation of the timer, the timed valve allowing the engine cleaner composition to discharge from the pressure-resistant container, through the timer, and through the length of tubing.

BRIEF DESCRIPTION OF THE DRAWINGS

The accompanying drawings, which are incorporated in and constitute a part of this application, illustrate aspects of the disclosure and together with a written description serve to explain some of the embodiments of the disclosure. A brief description of the drawings is as follows.

DETAILED DESCRIPTION

The embodiments of the present disclosure described below are not intended to be exhaustive or to limit the disclosure to the precise forms disclosed in the following detailed description. Rather a purpose of the embodiments chosen and described is so that the appreciation and understanding by others skilled in the art of the principles and practices of the present disclosure may be facilitated.

Figure 1:
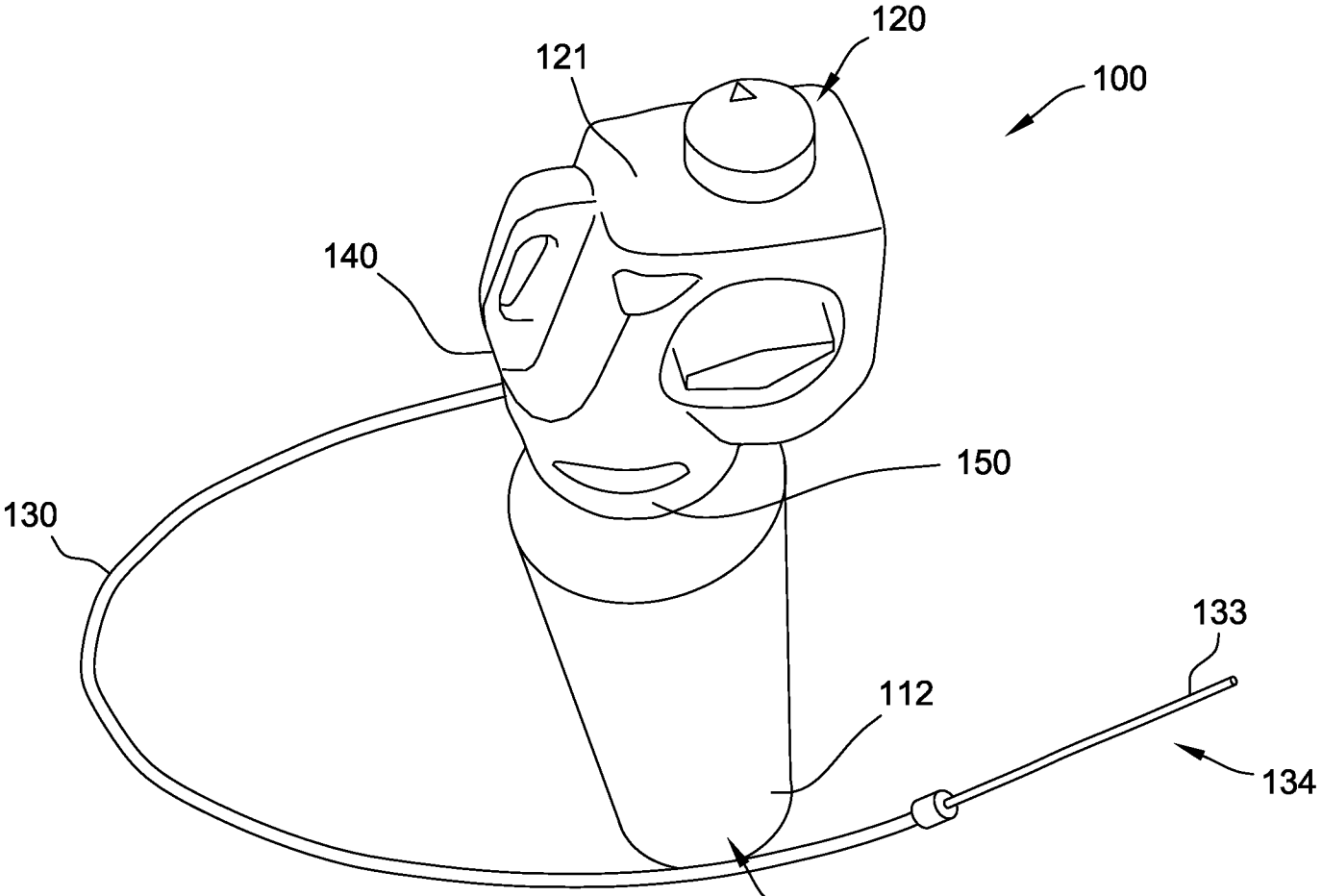
FIG. 1 is a perspective view of one suitable embodiment of a dispensing apparatus for cleaning an intake system of a GDI engine having an air intake manifold.

Turning now to the Figures, FIG. 1 is a perspective view of one suitable embodiment of a dispensing apparatus, indicated generally at 100, for cleaning an intake system of a GDI engine. For example, the GDI engine may be an automotive internal combustion engine having an air intake manifold (not shown). Dispensing apparatus 100 includes a pressure-resistant container, indicated at 110, including reservoir 112 and discharge orifice 414 (shown in FIG. 4). In some embodiments, reservoir 112 is charged with an engine cleaner composition. Dispensing apparatus 100 further includes a dispensing assembly 120 configured to receive fluid discharged from reservoir 112. In the illustrated embodiment, pressure-resistant container 110 and dispensing assembly 120 are in a coupled state, characterized in that dispensing assembly 120 is in fluid communication with pressure-resistant container 110.

Dispensing assembly 120 includes housing 121, assembly inlet 150, and assembly outlet 140 in fluid communication with assembly inlet 150. Assembly inlet 150 includes an interior region configured to house discharge orifice 414 when the dispensing assembly 120 and pressure-resistant container 110 are in a coupled state.

Dispensing assembly 120 includes length of tubing 130 including tubing inlet 332 (shown in FIG. 3) housed within housing 121 proximal to discharge orifice 414 and tubing outlet 134 located at a distal end of tubing 130. Tubing 130 includes a central bore extending from tubing inlet 332 to tubing outlet 134. Tubing 130 may have an outer diameter (OD), for example, within the range of about 1 mm to about 15 mm, and an inner diameter of about 0.5 mm to 10 mm. For example, in embodiments the OD can be about 1 mm, about 2 mm, about 3 mm, about 4 mm, about 5 mm, about 6 mm, about 7 mm, about 8 mm, about 9 mm, about 10 mm, about 12 mm, or about 15 mm. For example, in embodiments the ID can be about 0.5 mm, about 1 mm, about 1.5 m, about 2 mm, about 2.5 mm, about 3 mm, about 3.5 mm, about 4 mm, about 4.5 mm, about 5 mm, about 6 mm, about 7 mm, about 8 mm, about 9 mm, or about 10 mm. In some embodiments, tubing 130 comprises flexible material, for example rubber, silicone, flexible polymer, or any material that enables dispensing apparatus 100 to operate as described herein. Tubing inlet 332 is fluidly coupled to assembly outlet 140 for receiving fluid discharged from pressure-resistant container assembly 110 through dispensing assembly 120. In some embodiments, tubing 130 is sufficiently transparent to enable visual observation of fluid, within, or flowing through tubing 130. In embodiments, tubing 130 is formed from a material that is chemically resistant to the engine cleaner composition described herein. In the illustrated embodiment, tubing 130 includes tubing outlet 134 configured for insertion into an air intake manifold of a GDI engine. In some embodiments, a tubing outlet 134 (e.g., a tubing outlet end) includes rigid tubing section 133 to facilitate insertion of outlet 134 of tubing 130 into an air intake manifold of a GDI engine. In some embodiments, rigid tubing section 133 is a stiff member, for example metal guide, a stiff rod, tube or partial tube, attached to tubing 130. In some embodiments, rigid tubing section 133 includes a sleeve covering a portion of tubing 130. In some embodiments, rigid tubing section 133 is made from a material selected from metal and plastic. In yet other embodiments, rigid tubing section 133 is part of tubing 130 and formed of a material more rigid than tubing 130.

In some embodiments, dispensing assembly 120 includes at least one valve (not shown) configured to regulate a flowrate of engine cleaner composition through tubing 130. A wide variety of valves could be positioned in dispensing assembly 120 to regulate flow of engine cleaner fluid through tubing 130. In some embodiments, a valve such as a ball valve can be positioned in tubing 130 (e.g., proximal to the middle of tubing 130) to allow a user to manually adjust the valve, thereby regulating the flow of engine cleaner fluid through tubing 130.

In some embodiments, the engine cleaner composition comprises a cleaning fluid and a propellant. Example cleaning fluids may comprise amines, aminoesters, xylene, butyl cellosolve, ethyl benzene, and combinations thereof. Examples of cleaning fluids are described in, for example, U.S. Pat. Nos. 5,858,942; 6,541,435; 8,632,638; 8,809,248; US Patent Application No. 2018/0002645 and the like, the disclosures of which are incorporated herein by reference. In some embodiments, the propellant may be selected from one or more hydrocarbon propellants (e.g., a mixture of butane and propane), carbon dioxide, nitrogen, R134a, R1 234ze, HF0-1234yf, or any propellant that enables dispensing apparatus 100 to operate as described herein.

Figure 2:
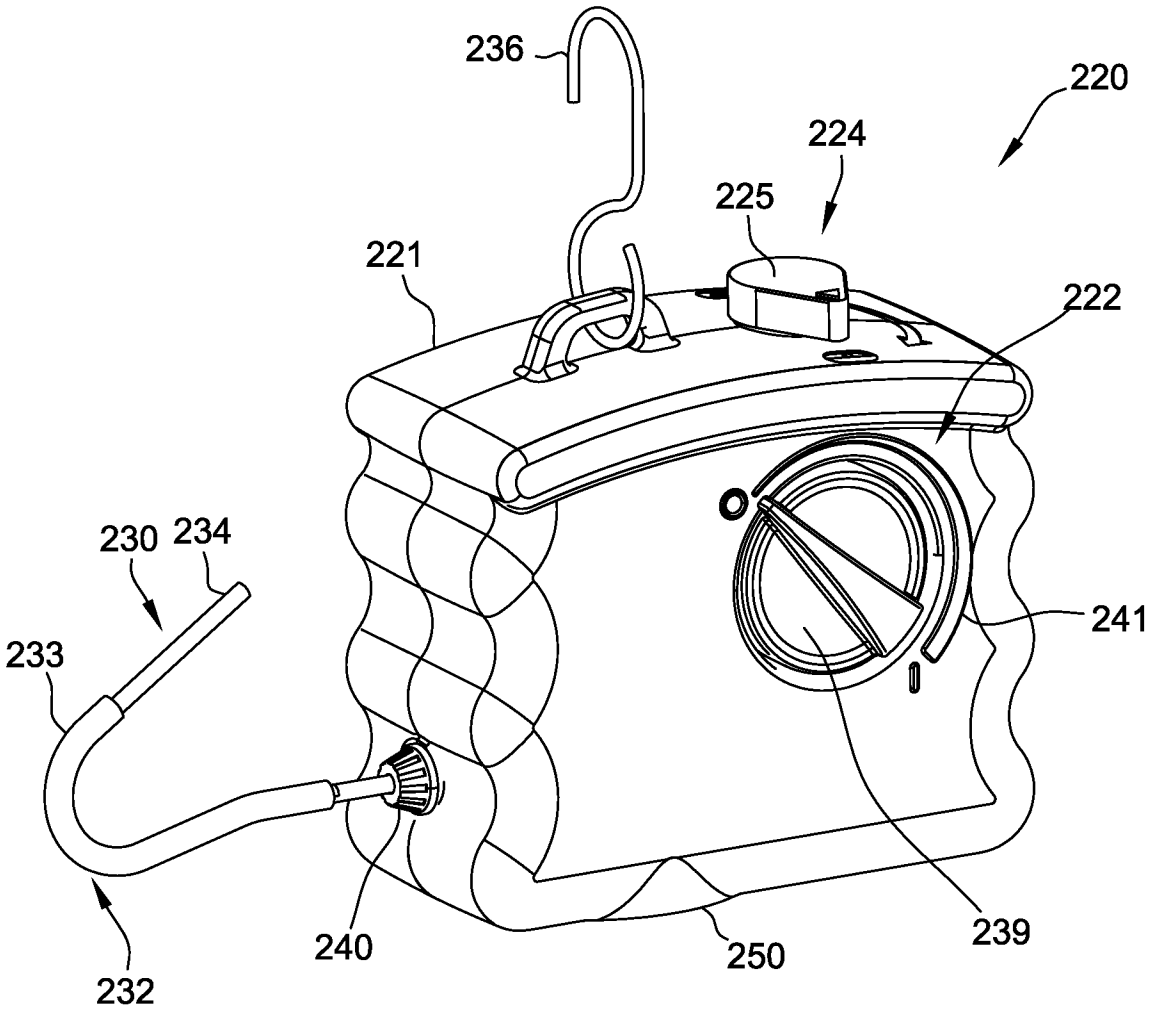
FIG. 2 is a perspective view of another suitable embodiment of a dispensing assembly of a dispensing apparatus for cleaning an intake system of a GDI engine having an air intake manifold.

FIG. 2 is a perspective view of another suitable embodiment of a dispensing assembly 220, which may be equivalent to dispensing assembly 120 of FIG. 1, for cleaning the intake system of an engine having an air intake manifold. In the illustrated embodiment, dispensing assembly 220 includes housing 221 and length of tubing 230. Dispensing assembly 220 further includes inlet 250 and outlet 240. In the illustrated embodiment, dispensing assembly 220 is in an uncoupled state, characterized in that dispensing assembly 220 is not in fluid communication with a pressure-resistant container 110. In other embodiments, dispensing assembly 220 may be separately provided to a product assembler, or separately to a user, without a pressure-resistant container 110 or length of tubing 130. In other embodiments, dispensing assembly 220 may be provided as a kit with a pressure-resistant container 110 and/or length of tubing 130.

In the illustrated embodiment, length of tubing 230, which may be equivalent to tubing 130 shown in FIG. 1, includes rigid tubing section 233 to facilitate insertion of tubing outlet 234 into an air intake manifold of an engine. In some embodiments, tubing outlet 234 may be biased in a general direction such that tubing outlet 234 (e.g., a tubing outlet end) tends to remain in a desired positioned. For example, tubing outlet 234 may be biased such that tubing outlet 234 resists moving out of an air intake manifold as an engine cleaner composition is discharged through tubing outlet 234 into the air intake manifold.

In the illustrated embodiment, length of tubing 230 includes curving portion 232 configured to orient tubing outlet 234 in a desired direction. In some embodiments, curving portion 232 is configured to prevent undesired movement of length of tubing 230 which may cause length of tubing 230 to move out of an air intake manifold as an engine cleaner composition is discharged through length of tubing 230 into the air intake manifold. In the illustrated embodiment, rigid tubing section 233 includes a curve substantially corresponding to a hook shape. In other embodiments, length of tubing 230 may include an L-shaped curving portion, a U-shaped curving portion, a V-shaped curving portion, or any other curve or curving shape that enables dispensing assembly 220 to operate as described herein.

In the illustrated embodiment, dispensing assembly 220 includes timer 222 configured to control a timed valve (shown in FIG. 3) housed within housing 221 that regulates fluid flow through dispensing assembly 220. When in an open position, the timed valve allows fluid to discharge from the pressure-resistant container 110 (shown in FIG. 1), through dispensing assembly 220, and through length of tubing 230. In some embodiments, the timed valve includes a plunger, a bisecting cylinder, a diaphragm, or any other structure that enables dispensing assembly 220 to operate as described herein.

In the illustrated embodiment, timer 222 includes winding mechanism 238 configured to control the timed valve housed within housing 221. Winding mechanism 238 enables a user to activate the timed valve such that timed valve opens after a predetermined length of time. In the illustrated embodiment, winding mechanism 238 includes rotatable dial switch 239 and indicator 241. In the illustrated embodiment, the predetermined length of time is determined by a clockwise rotation of rotatable dial switch 239 between an "O" and an "I" indicia of indicator 241. In other embodiments, winding mechanism 238 includes a vertically displacing switch, a horizontally displacing switch, or any other switch that enables dispensing assembly 220 to operate as described herein.

In some embodiments, timer 222 includes an electric timer having a control mechanism that activates the timed valve to open after the predetermined length of time. In some embodiments, the electric timer is powered by a battery. In some embodiments, the electric timer operates a switch that releases the timed valve, wherein the timed valve is positioned by a biasing member, for example a spring. In some embodiment, the electric timer operates a timed valve including a solenoid circuit on-off valve.

The predetermined length of time, or time delay, may be set to any desirable length of time. For example, the predetermined length of time may be 15 seconds, 30 seconds, one minute, two minutes, 3 minutes, 4 minutes, 5 minutes, or any other length of time that enables dispensing assembly 220 to operate as described herein. In the illustrated embodiment, the predetermined length of time begins after actuation of winding mechanism 238. In some embodiments, winding mechanism 238 is configured to delay opening of the timed valve for from 15 seconds to one minute after actuation of winding mechanism 238. In some embodiments, the predetermined length of time may be adjusted based on an average time it would take a user to activate winding mechanism 238 and proceed to enter a vehicle housing a GDI engine in need of cleaning, start the GDI engine, and rev the GDI engine.

In some embodiments, dispensing assembly 220 includes a solenoid circuit configured to start or stop the flow of an engine cleaner composition. For example, a user device could be used to remotely (e.g., while sitting in a vehicle) actuate the solenoid circuit to an on position or an off position by transmitting a wireless signal via a transmitter to a receiver in dispensing assembly 220. In some embodiments, the wireless signal is a Bluetooth signal, or other short range wireless signal. In some embodiments, the user can continuously actuate the solenoid circuit in an open position for a desired time period and then stop the flow of engine cleaner composition when cleaning is complete. Alternatively, a user could pulse the solenoid circuit on and off to provide a corresponding pulsed flow of engine cleaner composition to a manifold while the engine is running.

Figure 3:
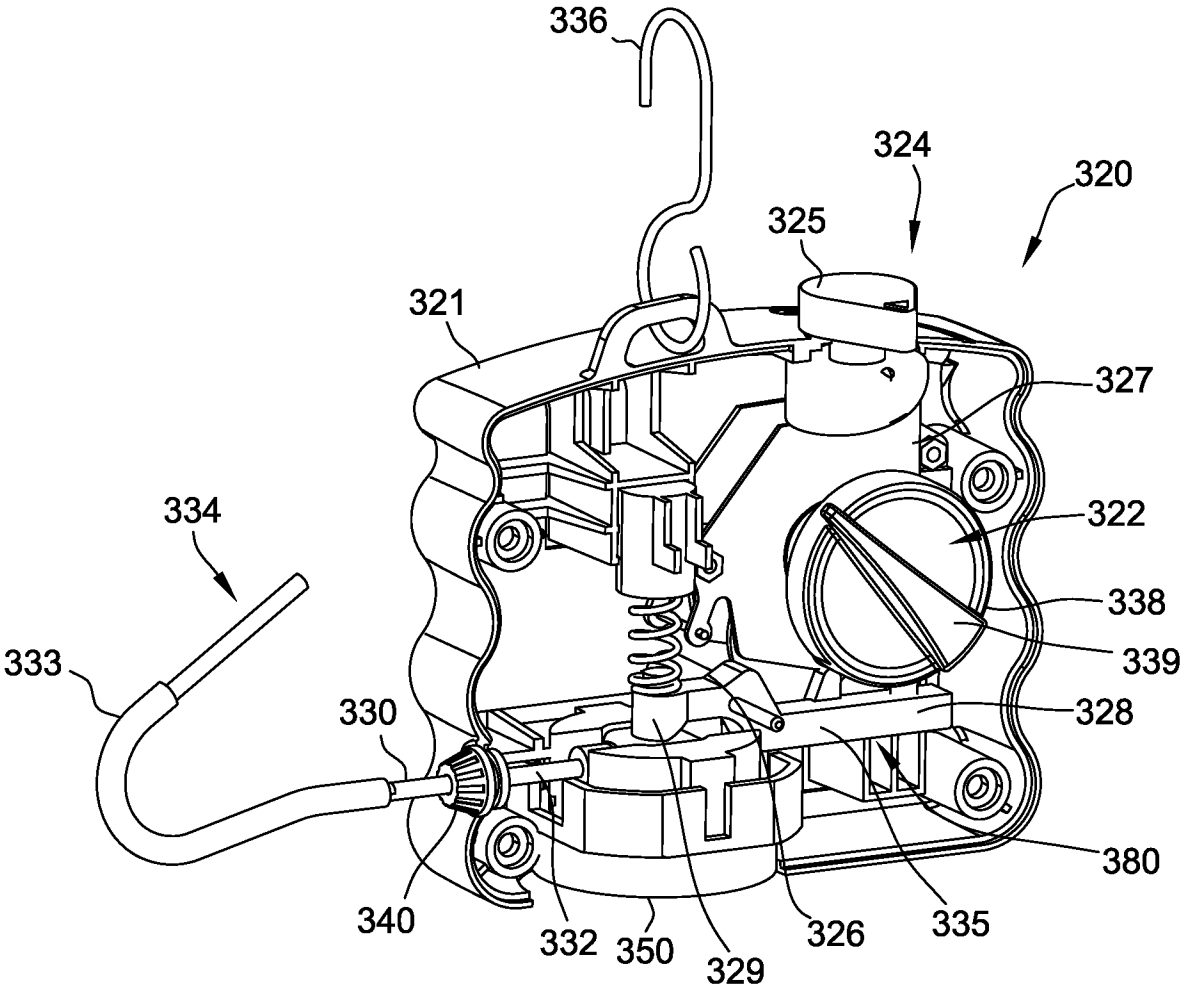
FIG. 3 is partial sectional view of an embodiment of a dispensing assembly of a dispensing apparatus for cleaning an intake system of a GDI engine having an air intake manifold.

In the illustrated embodiment, dispensing assembly 220 includes shut-off valve assembly 224 including shut-off valve actuator 225. When actuated by a user, shut-off valve actuator 225 engages a drive shaft housed within housing 221 (as shown in FIG. 3). When engaged by shut-off valve actuator 225, the drive shaft is configured to raise a distal end of a lever housed within housing 221. When the distal end of the lever is in a raised position, shut-off valve assembly 224 is in a closed position. In the closed position, shut-off valve assembly 224 seals a pressure-resistant container from the tubing inlet of dispensing assembly 220 when dispensing assembly 220 is coupled to the pressure-resistant container. Shut-off valve assembly 224 is configured to prevent inadvertent discharge of an engine cleaner composition. Additionally, separately operable shut-off valve assembly 224 permits an operator to stop flow of the engine cleaner composition if a cleaning procedure needs to be halted. Shut-off valve assembly 224 may be used to start or stop the flow at any point of time. When in the closed position, shut-off valve assembly 224 enables actuation of winding mechanism 238 to begin the predetermined length of time.

In the illustrated embodiment, dispensing assembly 220 includes attachment device 236 configured to facilitate attachment of dispensing assembly 220 to a supporting structure. For example, attachment device may include a hook shape, a magnet, suction cup, adhesive or other structure capable of facilitating attachment of the dispensing assembly 220 as described herein. For example, during a procedure for cleaning an engine of a vehicle, attachment device 236 may facilitate attachment, such as by hanging, of dispensing assembly 220 to a portion of the vehicle such that dispensing assembly 220 maintains an optimal position or orientation during the cleaning procedure.

It is noted that dispensing assembly 220 described herein could be used for a variety of fluids instead of an engine cleaner composition. Nonlimiting examples of such fluids include insecticides, fragrances, paints, foams, and the like. Such fluids could be used in combination with a propellant. Also, an apparatus that includes on-off valve and timer as described herein may be modified as desired depending on the fluid that is being discharged. For example, the assembly outlet may not be coupled to a hose and/or may be coupled to a nozzle that disperses the fluid into a surrounding environment.

FIG. 3 is a sectional view of dispensing assembly 320 including timer 322 and shut-off valve assembly 324. Dispensing assembly 320 may be equivalent to dispensing assembly 120 of FIG. 1. Dispensing assembly 320 further includes housing 321 and length of tubing 330. Length of tubing 330 includes tubing inlet 332 within housing 321 and tubing outlet 334. In the illustrated embodiment, dispensing assembly 320 may be included in a dispensing apparatus for cleaning an intake system of a GDI engine, in which dispensing assembly 320 is coupled to a pressure-resistant container at assembly inlet 350. In the illustrated embodiment, assembly inlet 350 is fluidly coupled to tubing inlet 332. Length of tubing 330 exits dispensing assembly 320 at assembly outlet 340.

In the illustrated embodiment, length of tubing 330 includes rigid tubing section 333 to facilitate insertion of tubing outlet 334 into an air intake manifold of an engine. In some embodiments, tubing outlet 334 may be biased in a general direction such that tubing outlet 334 (e.g., a tubing outlet end) tends to remain in a desired positioned. For example, tubing outlet 334 may be biased such that tubing outlet 334 resists moving out of an air intake manifold as an engine cleaner composition is discharged through tubing outlet 334 into the air intake manifold.

In the illustrated embodiment, dispensing assembly 320 includes timer 322 configured to control timed valve 380 within housing 321 that regulates fluid flow through dispensing assembly 320. When in an open position, timed valve 380 allows fluid to discharge from the pressure-resistant container, through dispensing assembly 320, and through length of tubing 330. In the illustrated embodiment, timed valve 380 includes biasing member 326 to bias timed valve 380 in a desired position. In the illustrated embodiment, biasing member 326 is a spring. In other embodiments, timed valve 380 includes a plunger, a bisecting cylinder, a diaphragm, or any biasing member that enables dispensing assembly 320 to operate as described herein.

In the illustrated embodiment, timer 322 includes winding mechanism 338 configured to control timed valve 380 housed within housing 321. Winding mechanism 238 enables a user to activate timed valve 380 such that timed valve 380 opens after a predetermined length of time. In the illustrated embodiment, winding mechanism 338 includes rotatable dial switch 339. In other embodiments, winding mechanism 338 includes a vertically displacing switch, a horizontally displacing switch, or any other mechanical, electronic or digital switch that enables dispensing assembly 320 to operate as described herein.

In the illustrated embodiment, dispensing assembly 320 includes separately operable shut-off valve assembly 324 including shut-off valve actuator 325. When actuated by a user, shut-off valve actuator 325 engages drive shaft 327. When engaged by shut-off valve actuator 325, drive shaft 327 is configured to engage a proximal end 328 of lever 335 to raise distal end 329 of lever 335. When distal end 329 of lever 335 is in a raised position, shut-off valve assembly 324 is in a closed position. In the closed position, shut-off valve assembly 324 seals a pressure-resistant container from tubing inlet 332 of dispensing assembly 320 when dispensing assembly 320 is coupled to the pressure-resistant container. Shut-off valve assembly 324 is configured to prevent inadvertent discharge of an engine cleaner composition. Additionally, shut-off valve assembly 324 permits an operator to stop flow of the engine cleaner composition if a cleaning procedure needs to be halted. Shut-off valve assembly 324 may be used to start or stop the flow at any point of time. When in the closed position, shut-off valve assembly 324 enables actuation of winding mechanism 338 to begin the predetermined length of time.

In the illustrated embodiment, dispensing assembly 320 includes attachment device 336 configured to facilitate attachment of dispensing assembly 320 to a supporting structure. For example, during a procedure for cleaning an engine of a vehicle, attachment device 336 may facilitate attachment of dispensing assembly 320 to a portion of the vehicle such that dispensing assembly 320 maintains an optimal position or orientation during the cleaning procedure.

During a cleaning operation, an engine cleaner composition is discharged from a pressure-resistant container into assembly inlet 350, and the engine cleaner composition flows past shut-off valve assembly 324. As shown, the shut-off valve assembly 324 is actuated by shut-off valve actuator 325. In the illustrated embodiment, shut-off valve actuator 325 includes a rotatable knob. When the shut-off valve actuator 325 is in an "off" position, drive shaft 327 is pressed down and distal end 329 of lever 335 is moved upward. At this time, timed valve is closed and winding mechanism 338 of timer 322 can be rotated to begin the predetermined length of time.

After opening of shut-off valve assembly 324, flow of engine cleaner composition is determined by timer 322, which controls timed valve 380. Timed valve 380 includes a valve structure that impedes flow through dispensing assembly 320 and, when opened, allows engine cleaner composition to discharge from the pressure-resistant container, through dispensing assembly 320, and through length of flexible tubing 330. When the predetermined length of time has elapsed while shut-off valve assembly 324 is in the open position, distal end 329 of lever 335 is forced down by biasing member 326, which actuates an aerosol valve structure in the pressure-resistant container such that engine cleaner composition can flow through assembly 320 as described herein.

In use, any one of the fluid-dispensing devices as described herein is provided, and the user opens the hood of the vehicle and locates the vehicle's engine air intake. The pressure-resistant container including the cleaner composition is preferably secured, so that it does not need to be held by a person during the cleaning process.

In an embodiment, the pressure-resistant container can be secured under the hood or can be hung using an attachment device, for example attachment device 236. In an embodiment, the pressure-resistant container is secured in an orientation wherein the on-off valve and timer is positioned below the pressure-resistant container (i.e. the pressure-resistant container is inverted).

Figure 4:
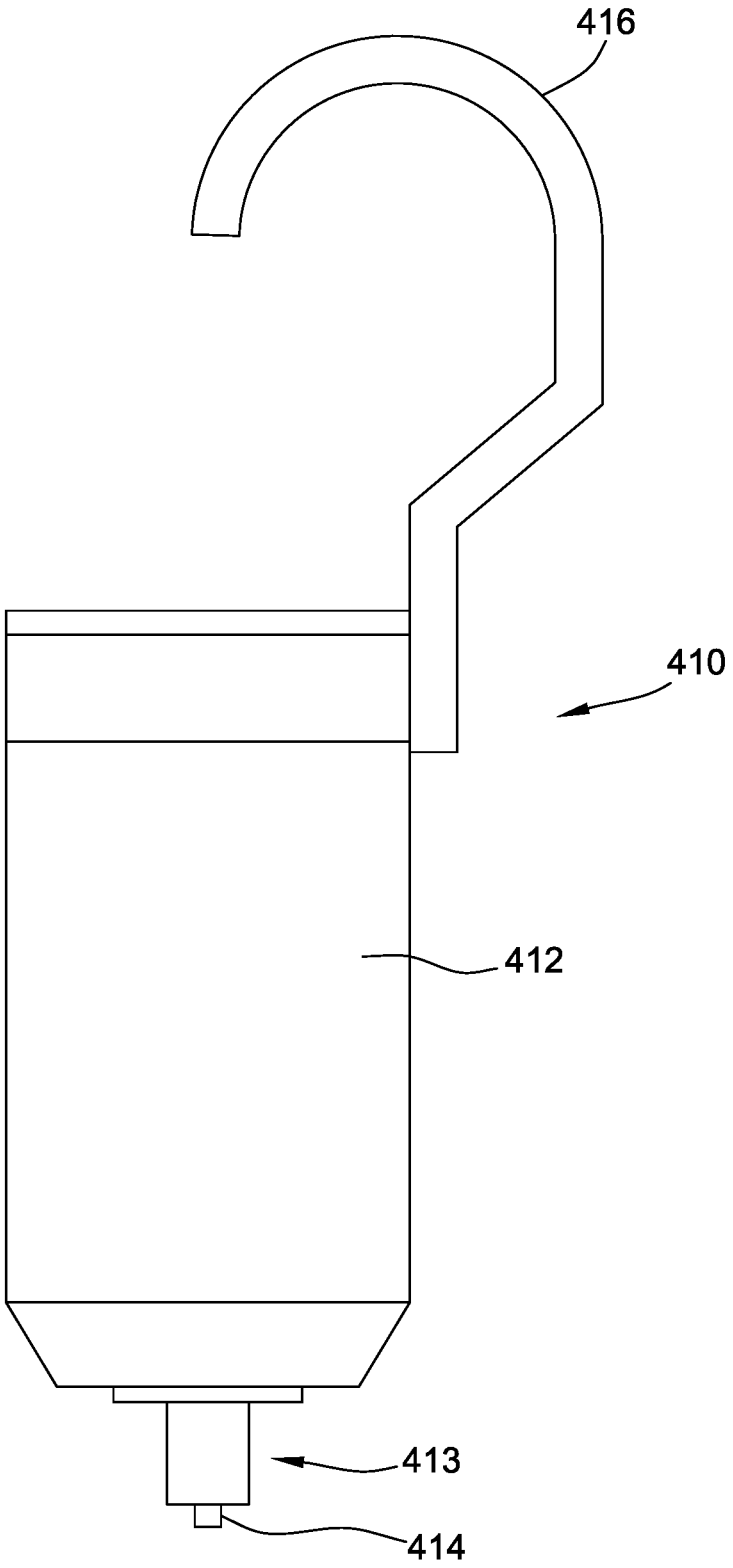
FIG. 4 is a perspective view of an embodiment of a pressure-resistant container of a dispensing apparatus for cleaning an intake system of a GDI engine having an air intake manifold.

FIG. 4 shows an embodiment of pressure-resistant container 410 having reservoir 412 and valve 413 including discharge orifice 414. Pressure-resistant container 410 may be equivalent to pressure-resistant container 110 shown in FIG. 1. In some embodiments, valve 413 is an aerosol valve and discharge orifice 414 is a valve stem. In the illustrated embodiment, valve 413 is adapted to contain fluid contents in reservoir 412 until valve 413 is actuated to allow the engine cleaner composition to flow from discharge orifice 414 due to the fluid being at a relatively higher pressure in reservoir 412. In some embodiments, pressure-resistant container 410 is provided with attachment device 416 for mounting pressure-resistant container 410 in an inverted position during use.

In some embodiments, pressure-resistant container 410 is secured in an orientation wherein the timer is positioned above the pressure-resistant container 410 such that the pressure-resistant container is upright so that discharge orifice 414 is positioned upright.

Figure 5:
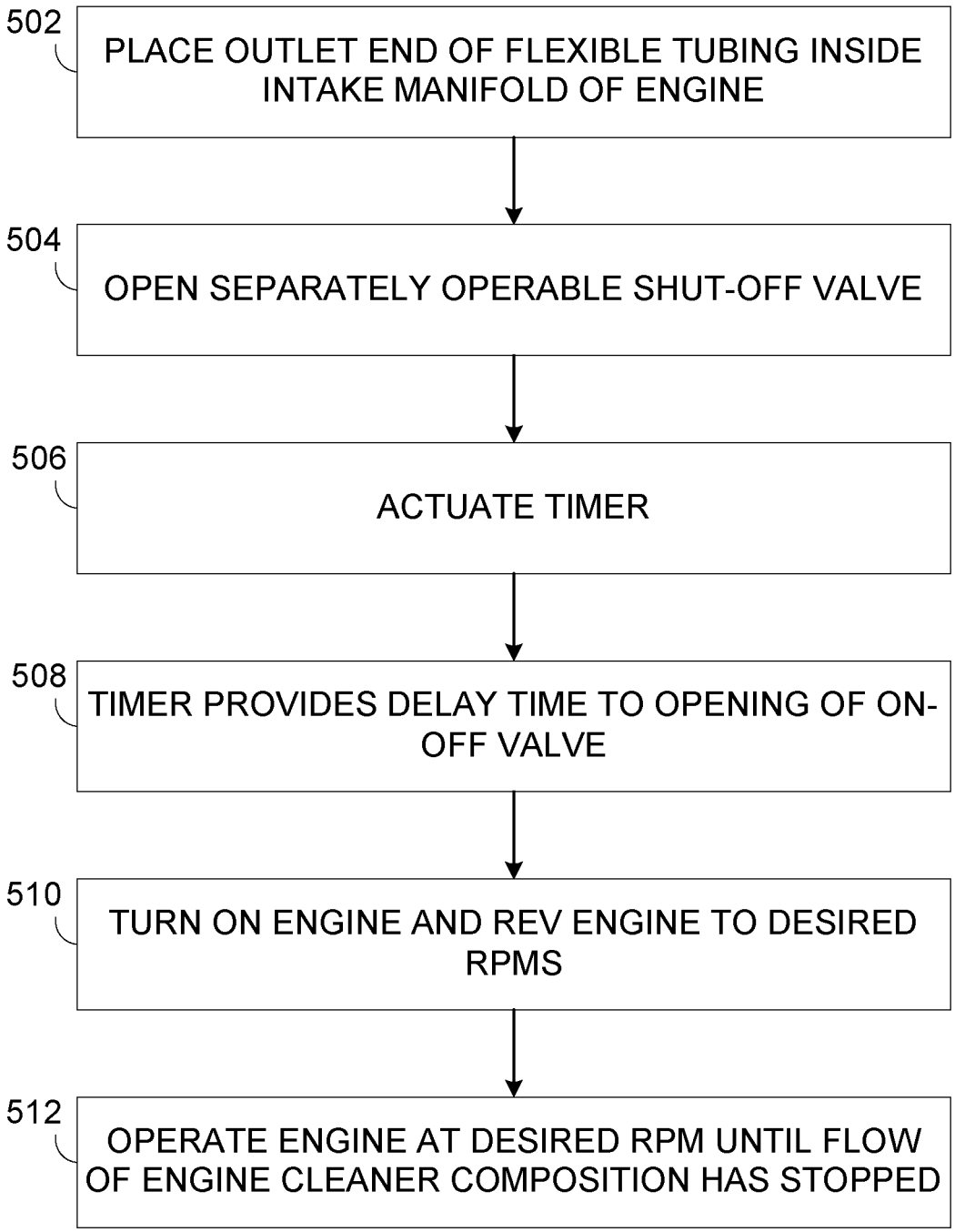
FIG. 5 is a simplified flowchart illustrating an example cleaning process utilizing a dispensing apparatus for cleaning an intake system of an engine.

FIG. 5 is a simplified flowchart illustrating an example cleaning process utilizing an apparatus for cleaning an intake system of an engine. For example, the end of the flexible tubing, for example a rigid end of tubing section 133 of tubing outlet 134 shown in FIG. 1, is placed inside the intake manifold 502 at appropriate distance and secured so that it remains in place throughout the cleaning process. During some cleaning processes, the engine may be run for several minutes before initiating the cleaning process, which can be before, during or after set up of the fluid-dispensing device as described above.

To carry out a cleaning process, a user opens the separately operable shut-off valve 504, if present, to enable delivery of the engine cleaner composition to the air intake manifold. Then the user actuates the timer 506.

The timer provides a short delay time to opening of the on-off valve 508 for as long as two minutes after actuation of the timer 506 to provide the user with enough time to get into the car, turn on the engine (if not already running) and rev the engine to the desired rpms 510 (e.g., from about 1500 to about 2500 rpms) for proper cleaning. The incorporation of a timer delay thus greatly facilitates completion of the cleaning process by a single person, without assistance.

The user continues to operate the car engine at the desired rpm 510 rate until the flow of the engine cleaner composition has stopped 512. The completion of delivery of engine cleaner composition may be determined by waiting for the time period usually associated with delivery of the engine cleaner composition for the particular fluid-dispensing device being used. Alternatively, the delivery of engine cleaner composition may be confirmed by visually ensuring that the flow has stopped from the pressure-resistant container into the intake manifold. The transparent nature of hose in certain embodiments greatly facilitates visual confirmation of completion of the flow of the engine cleaner composition.

It has been found that the apparatus and method as described herein greatly facilitates delivery of engine cleaner composition to the intake system of an automotive internal combustion engine in a precise, controlled manner, and the resulting method in particular is effective in chemically cleaning undesired carbon deposits in the engine.

In an embodiment, the method is carried out on an internal combustion engine. In an embodiment, the method is carried out on a fuel injected internal combustion engine. In an embodiment, the method is carried out on a Gas Direct Injection internal combustion engine.

Throughout this specification and claims, unless the context requires otherwise, the word "comprise", and variations such as "comprises" and "comprising", will be understood to imply the inclusion of a stated integer or step or group of integers or steps but not the exclusion of any other integer or step or group of integer or step. When used herein "consisting of" excludes any element, step, or ingredient not specified in the claim element. When used herein, "consisting essentially of" does not exclude materials or steps that do not materially affect the basic and novel characteristics of the claim. In the present disclosure of various embodiments, any of the terms "comprising", "consisting essentially of" and "consisting of" used in the description of an embodiment may be replaced with either of the other two terms.

All percentages and ratios used herein are weight percentages and ratios unless otherwise indicated. All patents, patent applications (including provisional applications), and publications cited herein are incorporated by reference as if individually incorporated for all purposes. Numerous characteristics and advantages of the embodiments meant to be described by this document have been set forth in the foregoing description. It is to be understood, however, that while particular forms or embodiments have been illustrated, various modifications, including modifications to shape, and arrangement of parts, and the like, can be made without departing from the spirit and scope of the disclosure.

What is claimed is:

1. An apparatus for cleaning an intake system of an engine comprising:

a pressure-resistant container comprising:

a reservoir charged with an engine cleaner composition under pressure;

a discharge orifice passing through the reservoir for providing a discharge of the engine cleaner composition under pressure from the reservoir; and an aerosol valve within the discharge orifice adapted to contain the engine cleaner composition under pressure within the reservoir; and a dispensing assembly comprising:

an assembly inlet coupled to the discharge orifice of the pressure-resistant container for receiving the discharge of the engine cleaner composition under pressure from the pressure-resistant container;

an assembly outlet;

a length of tubing comprising:

a tubing inlet;

a tubing outlet; and a central bore extending from the tubing inlet to the tubing outlet, wherein the tubing inlet is in fluid communication with the assembly outlet for receiving the engine cleaner composition under pressure from the dispensing assembly;

a lever configured to selectively engage the aerosol valve to discharge the engine cleaner composition under pressure from the pressure-resistant container;

a shut-off assembly, coupled to the lever, switchable between a closed position preventing the lever from engaging the aerosol valve to discharge the engine cleaner composition under pressure from the pressure-resistant container and an opened position enabling the lever to engage the aerosol valve to allow the discharge of the engine cleaner composition under pressure from the pressure-resistant container; and a timed switch coupled to the lever and including a user-actuated timer, wherein actuation of the timer and setting the shut-off assembly to the open position initiates a cleaning operation by the apparatus while the timed switch prevents the lever from engaging the aerosol valve to cause an initial release of the discharge of the engine cleaner composition under pressure from the apparatus for a predetermined period of time after actuation of the timer.

2. The apparatus of claim 1, further comprising a biasing member configured to position the lever to actuate the aerosol valve when the shut-off assembly is in the opened position and the predetermined period of time after actuation of the timer has elapsed.

3. The apparatus of claim 1, wherein the timer comprises a winding mechanism coupled to a control mechanism configured to activate the lever after the predetermined period of time.

4. The apparatus of claim 3, wherein the timer is powered by a battery.

5. The apparatus of claim 1, wherein the timer comprises an electric timer having a control mechanism configured to activate the lever after the predetermined period of time.

6. The apparatus of claim 5, wherein the lever is positioned by a biasing member to actuate the aerosol valve.

7. The apparatus of claim 1, wherein the shut-off assembly includes a drive shaft that in the closed position presses against the lever, preventing the lever from engaging the aerosol valve.

8. The apparatus of claim 1, wherein the length of tubing is sufficiently transparent to enable visual observation of the engine cleaner composition flowing through the tubing.

9. The apparatus of claim 1, wherein the pressure-resistant container further comprises an attachment device configured for mounting the pressure-resistant container above the engine in an inverted position or upright position during use.

10. The apparatus of claim 1, further comprising:

a metal guide configured to direct a flow of the engine cleaner composition in a desired direction, wherein the length of tubing further comprises a sleeve that covers at least a portion of the tubing.

11. The apparatus of claim 1, wherein the predetermined period of time is from about 15 seconds to about 80 seconds after actuation of the timer.

12. The apparatus of claim 1, further comprising at least one valve within the tubing to regulate a flow of the engine cleaner composition through the length of the tubing.

13. The apparatus of claim 1, wherein the dispensing assembly comprises a solenoid circuit in communication with an actuator, wherein the solenoid circuit is configured to receive a wireless signal from a user device to actuate the actuator from an off position where no engine cleaner composition is discharged by the aerosol valve from the pressure-resistant container to an on position where engine cleaner composition is discharged by the aerosol valve from the pressure-resistant container.

14. A method of using an apparatus for cleaning an engine having an air intake manifold, wherein the apparatus comprises:

a fluid-dispensing device comprising a pressure-resistant container having a reservoir, a discharge orifice through the reservoir, and an aerosol valve within the discharge orifice, wherein the reservoir is charged with an engine cleaner composition under pressure and the aerosol valve is adapted to contain the engine cleaner composition within the reservoir;

a dispensing assembly having a lever, a shut-off assembly coupled to the lever, a timed switch coupled to the lever and including a user-actuated timer, an assembly inlet coupled to the discharge orifice, and an assembly outlet, wherein the shut-off assembly, when in a closed position, prevents the lever from engaging the aerosol valve to discharge the engine cleaner composition under pressure from the pressure-resistant container and, an opened position, enabling the lever to engage the aerosol valve to allow the discharge of the engine cleaner composition under pressure from the pressure-resistant container;

a length of tubing having a tubing inlet connected with the assembly outlet, a tubing outlet, and a central bore extending from the tubing inlet to the tubing outlet;

the method comprising:

actuating a count, by the timer, to initiate a cleaning operation by the apparatus and to delay the lever from engaging the aerosol valve to cause an initial release of the discharge for a predetermined period of time after actuation of the count by the timer;

setting the shut-off assembly in the open position;

maintaining the lever in a position to delay an initial release of the discharge of the engine cleaner composition under pressure from the apparatus for the predetermined period of time; and automatically actuating the aerosol valve, by the timed switch and the lever after the predetermined period of time, and allowing the engine cleaner composition under pressure to discharge from the pressure-resistant container through the length of tubing.

15. The method of claim 14, wherein the engine is operated prior to discharge of the engine cleaner composition through the tubing and into an air intake manifold of the engine.

16. The method of claim 14, wherein the engine is started after actuating the count by the timer.

17. The method of claim 14, wherein a rotations per minute (RPM) of the engine is operated to be elevated from idle.

18. The method of claim 14, further comprising operating the engine to run at from about 1500 to about 2500 RPM.

19. The method of claim 14, wherein the engine is operated to run at an RPM that is elevated from idle until the discharge of the engine cleaner composition through the tubing and into an air intake manifold of the engine is substantially complete.

20. The method of claim 14, further comprising maintaining the timed valve in the closed condition for from about 15 seconds to about 80 seconds after actuating the count by the timer.

* * * * *